US009635984B2

(12) United States Patent
Pierce

(10) Patent No.: US 9,635,984 B2
(45) Date of Patent: May 2, 2017

(54) SHOWER CURTAIN AND ATTACHED SHOWER CURTAIN LINER AND CLIPS

(71) Applicant: Scott Pierce, Henderson, NV (US)

(72) Inventor: Scott Pierce, Henderson, NV (US)

( * ) Notice: Subject to any disclaimer, the term of this patent is extended or adjusted under 35 U.S.C. 154(b) by 0 days.

(21) Appl. No.: 14/479,212

(22) Filed: Sep. 5, 2014

(65) Prior Publication Data

US 2014/0373267 A1 Dec. 25, 2014

Related U.S. Application Data

(63) Continuation-in-part of application No. 13/553,718, filed on Jul. 19, 2012.

(60) Provisional application No. 61/509,962, filed on Jul. 20, 2011, provisional application No. 61/525,305, filed on Aug. 19, 2011.

(51) Int. Cl.
*A47K 3/38* (2006.01)
*A47H 13/04* (2006.01)

(52) U.S. Cl.
CPC ..... *A47K 3/38* (2013.01); *A47H 13/04* (2013.01)

(58) Field of Classification Search
CPC ..... A47K 3/38; A47H 13/04; A47H 13/06; A47H 13/02
USPC ..... 4/558, 608
See application file for complete search history.

(56) References Cited

U.S. PATENT DOCUMENTS 345,904 A 7/1886 Kenney
443,981 A 12/1890 Braren
1,236,888 A * 8/1917 Sweney ..... A47H 13/02 160/382
1,465,938 A * 8/1923 Guider ..... A47H 13/02 16/87.2
1,666,298 A 4/1928 Norris
1,979,674 A 11/1934 Cowan
2,188,163 A * 1/1940 Sherman ..... 160/327
2,320,003 A 5/1943 Madan
2,512,376 A * 6/1950 Perlmutter ..... A47H 13/04 160/348
5,586,375 A 12/1996 Cooperman et al.
5,787,954 A 8/1998 Herrera
(Continued)

OTHER PUBLICATIONS

Search Opinion from European Patent Application No. 15153473.2.

*Primary Examiner* — Janie Loeppke
(74) *Attorney, Agent, or Firm* — Fisher Broyles, LLP; Rob L. Phillips

(57) ABSTRACT

A shower curtain and series of clips or hooks integral therewith. The clips are single pre-fabricated members including a lower/shower curtain portion and upper/hanger portion. The shower curtain portion retains a shower curtain while the hanger portion attaches to a shower curtain rod. The shower curtain portion may be square-shaped, rectangular or the like and may be received by, and substantially encapsulated by, an internal space defined by layers of shower curtain material at an upper edge thereof. The shower curtain portion is configured to fit onto a shower curtain rod. Advantageously, when attached to the shower curtain rod using the series of clips described herein, the shower curtain is substantially flat or flush relative to the shower curtain rod and/or the clips are concealed in part or completely from a position outside of the shower/bathtub. A shower curtain liner may be attached to the shower curtain.

8 Claims, 14 Drawing Sheets

(56) References Cited

U.S. PATENT DOCUMENTS

| | | | | |
|---|---|---|---|---|
| 6,038,749 | A * | 3/2000 | Eberhardt | 24/306 |
| 2007/0277355 | A1 | 12/2007 | Richardson | |

* cited by examiner

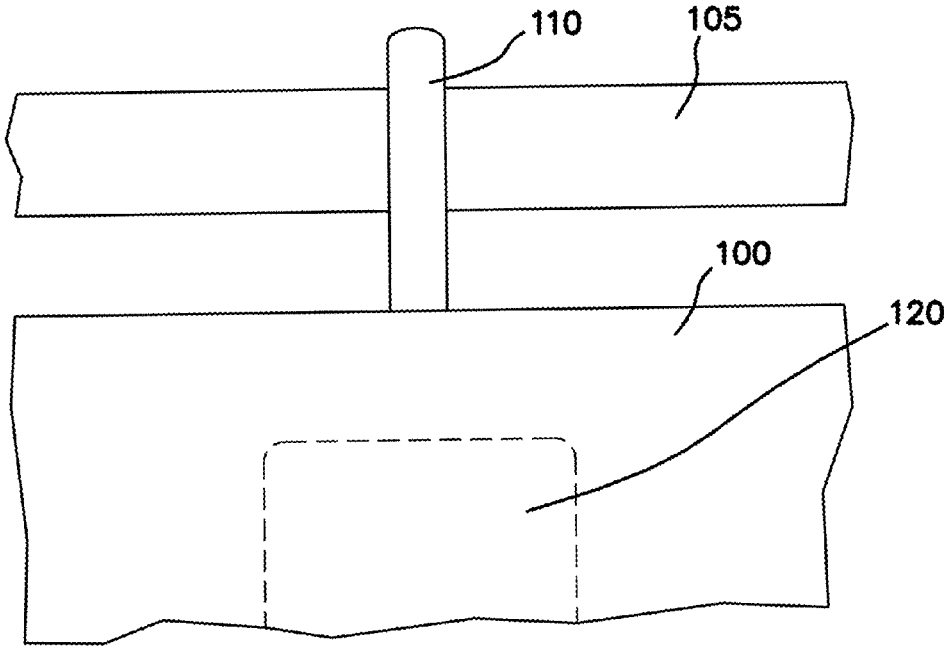
FIG. 6
FIG. 7
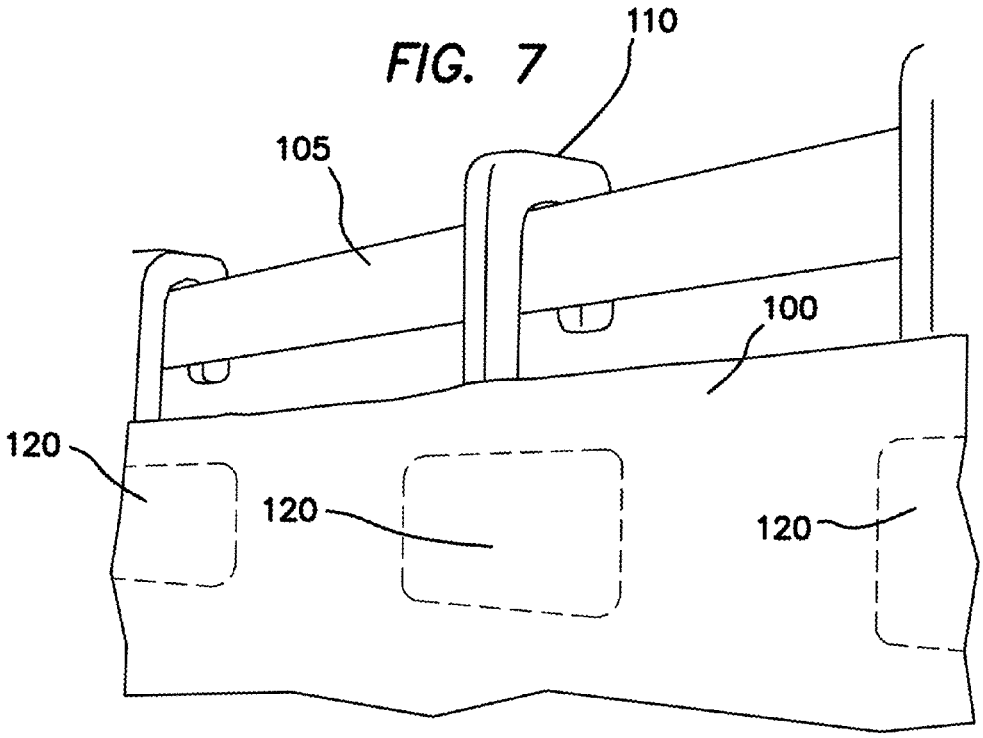

FIG. 10A
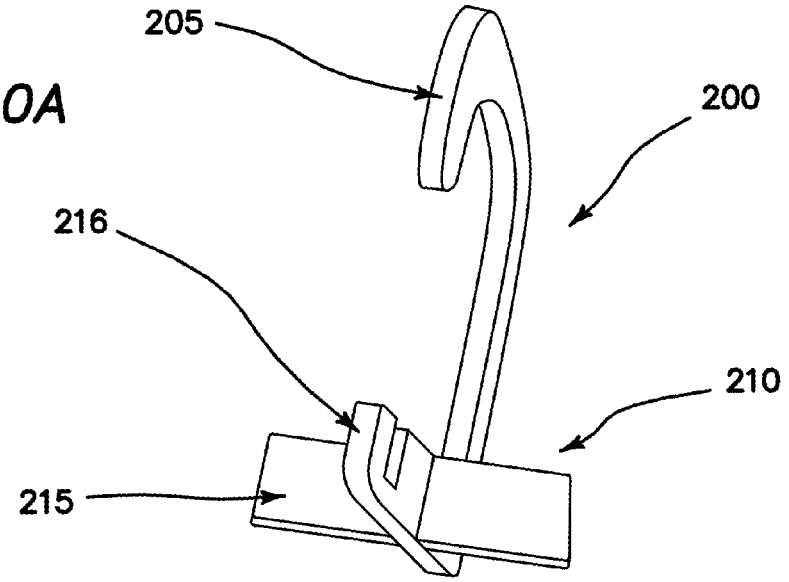
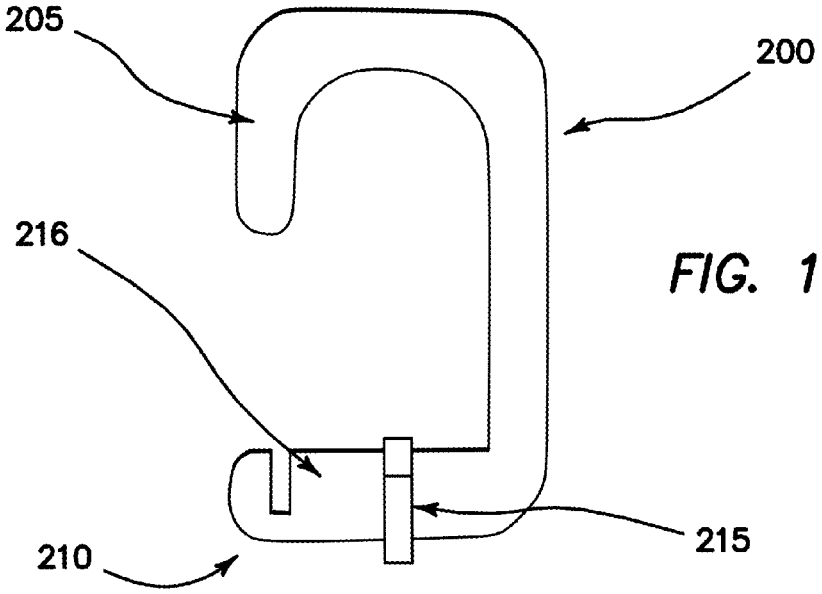
FIG. 10B

SHOWER CURTAIN AND ATTACHED SHOWER CURTAIN LINER AND CLIPS

CROSS REFERENCE

This application claims the benefit of U.S. patent application Ser. No. 13/553,718 filed on Jul. 19, 2012 which claims priority to U.S. Provisional Patent Application No. 61/509,962 filed Jul. 20, 2011 and U.S. Provisional Patent Application No. 61/525,305 filed Aug. 19, 2011 all of which are incorporated herein by reference for all purposes.

FIELD OF THE INVENTION

The embodiments of the present invention relate to curtains incorporating novel clips to hang from a curtain rod eliminating cumbersome hooks and loops.

BACKGROUND

Curtains, including shower curtains, have traditionally relied on hooks or loops for attachment to curtain rods. However, hooks and loops are ineffective and/or cumbersome and in some cases require the curtain rod to be removed before the hooks or loops may be placed thereon or alternatively the loops may each need to be opened and placed over the curtain rod.

It would therefore be advantageous to develop a more effective and easy-to-use curtain attachment system.

SUMMARY

Accordingly, the embodiments of the present invention involve a shower curtain and series of clips integral with an upper edge of the shower curtain. The clips are a single pre-fabricated member including a lower/shower curtain portion and upper/hanger portion. The shower curtain portion is configured to retain a shower curtain while the hanger portion is configured to attach to a shower curtain rod. In one embodiment, the shower curtain portion is a flat square-shaped member which may be sandwiched between opposite shower curtain flaps. The shower curtain portion is positioned substantially orthogonally (i.e., 90°) relative to the flat hanger portion. Other embodiments include a clip with a hook portion, shower curtain portion and rectangular retention member and a clip with a hook portion, shower curtain portion and rib. The shower curtain portion defines a space and opening for allowing the clip to fit onto a shower curtain rod. Advantageously, when attached to the shower curtain rod using the series of clips described herein, the shower curtain is substantially flat or flush relative to the shower curtain rod as opposed to comprising peaks and valleys as with the traditional hooks, loops or similar attachment mechanisms.

In an alternative shower curtain embodiment, a shower curtain liner is attached to said shower curtain and held on a shower curtain rod by clips/hooks in an upper portion space of said shower curtain.

Other variations, embodiments and features of the present invention will become evident from the following detailed description, drawings and claims.

BRIEF DESCRIPTION OF THE DRAWINGS

FIGS. 6 and 7 illustrate close-up front and perspective views of the first clips integrated with a shower curtain according to the embodiments of the present invention;

FIGS. 10A and 10B illustrate a front perspective and side view, respectively, of a second clip according to the embodiments of the present invention;

DETAILED DESCRIPTION

Figure 1:
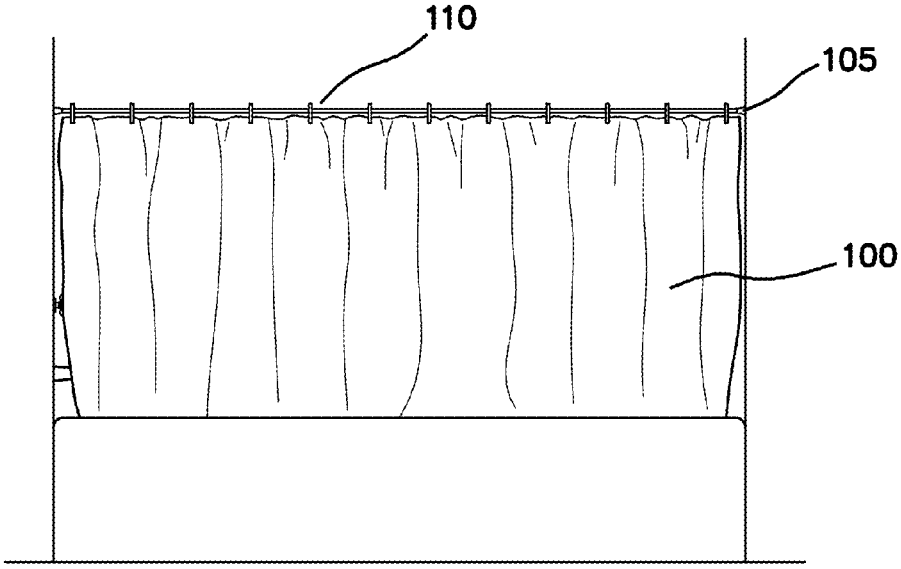
FIG. 1 illustrates a shower curtain attached to a shower curtain rod using a first clip according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The clips described herein may be fabricated of plastic, alloys, metals, polymers, composites and the like using molding, machining, rapid prototyping and similar techniques. In one embodiment, the clips are fabricated of Celcon M-90 allowing the curtain and clips to be washed and dried together without the need for removing the clips.

While the detailed description below focuses on shower curtains, conventional curtains (e.g., drapes) are covered by, and benefit from, the embodiments of the present invention.

FIG. 1 shows a shower curtain 100 attached to a shower curtain rod 105 using first clips 110 according to the embodiments of the present invention. The design of the first clip 110 facilitates the shower curtain 100 being flush or flat relative to the shower curtain rod 105. In one embodiment, the first clips 110 are spaced approximately 6 inches along the top of the shower curtain 100. In this manner, the shower curtain 100 may slide along the shower curtain rod 105 allowing ingress and egress for a shower user.

Figure 4:
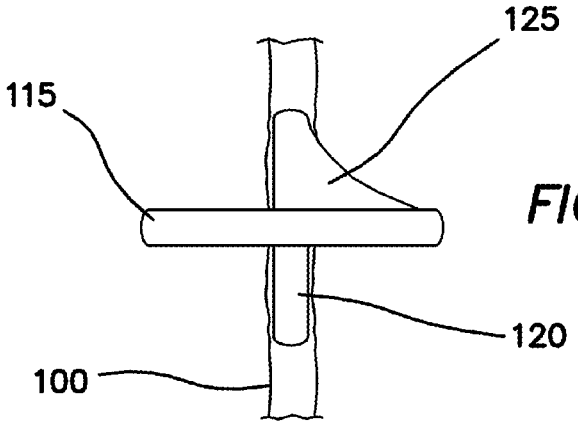
FIGS. 2-4 illustrate a side, rear and top view, respectively, of the first clip according to the embodiments of the present invention.
Figure 2:
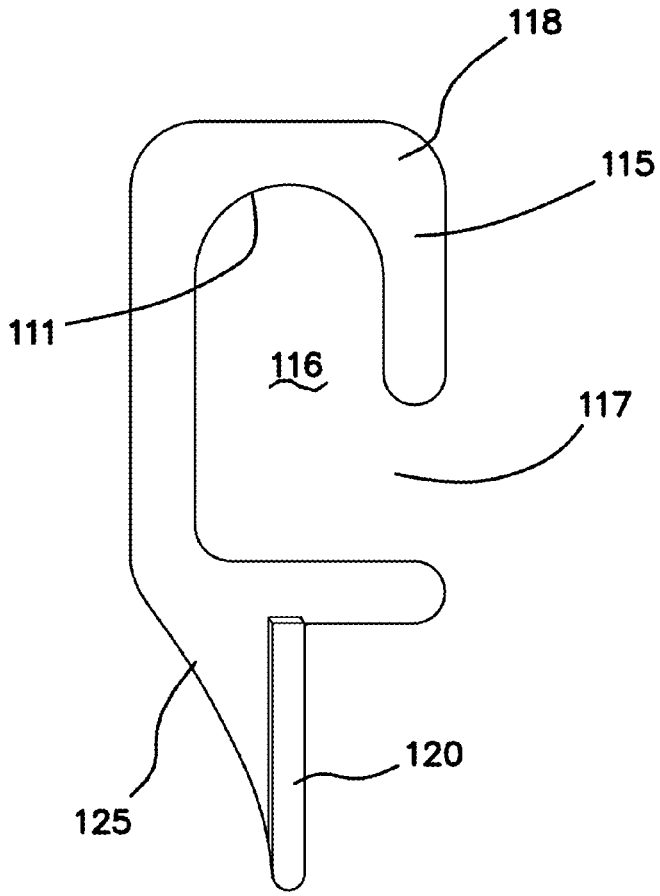
Figure 3:
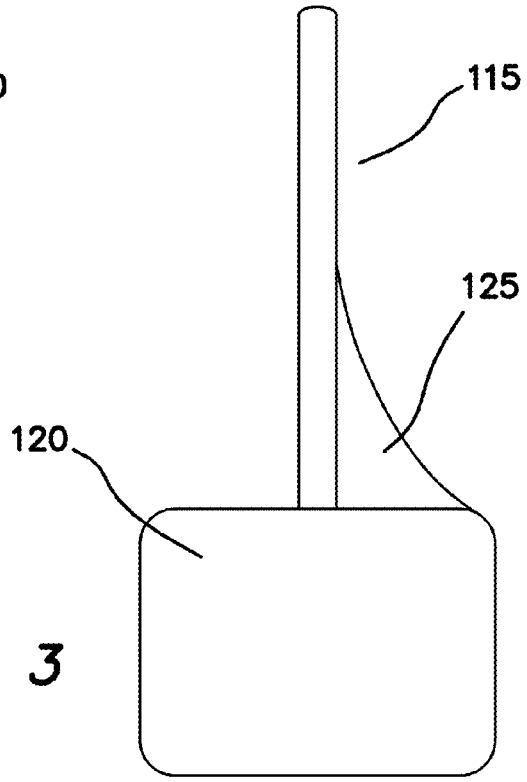

FIGS. 2, 3 and 4 show various views of the first clip 110. FIG. 2 shows a first side view showing a hanger portion 115 and shower curtain portion 120 (curtain portion for conventional drapes). The hanger portion 115 defines a space 116 and opening 117 allowing the clip 110 to be placed on the shower curtain rod 105. In one embodiment, an under surface 118 of the hanger portion 115 of the clip 110 includes a metallic or similar material or coating 111 which facilitates sliding of the clip 110 along the shower curtain rod 105. In one embodiment, a wedge 125 extends from the shower curtain portion 120 to the hanger portion 115. The wedge 125 adds stability to the clip 110.

In one embodiment, the shower curtain portion 120 comprises a square-shaped member 121 and lower horizontal member 122 wherein the square-shaped retention member 121 is received by an elongated internal space 123 defined by an elongated upper portion of the shower curtain 100 and wherein the lower horizontal member 122 extends through one of a series of openings 124 along the upper portion of the shower curtain 100. The internal space 121 is between fabric layers in the upper portion of the shower curtain 100 and permits the clips 110 to retain the shower curtain 100. FIG. 3 also shows the substantially orthogonal (i.e., 90°) relationship between the hanger portion 115 and shower curtain portion 120 as well as the wedge 125 extending therebetween. FIG. 4 shows a top view of the clip 110 with the square-shaped member 121 received by the space 123 in the upper portion of the shower curtain 100.

Figure 5:
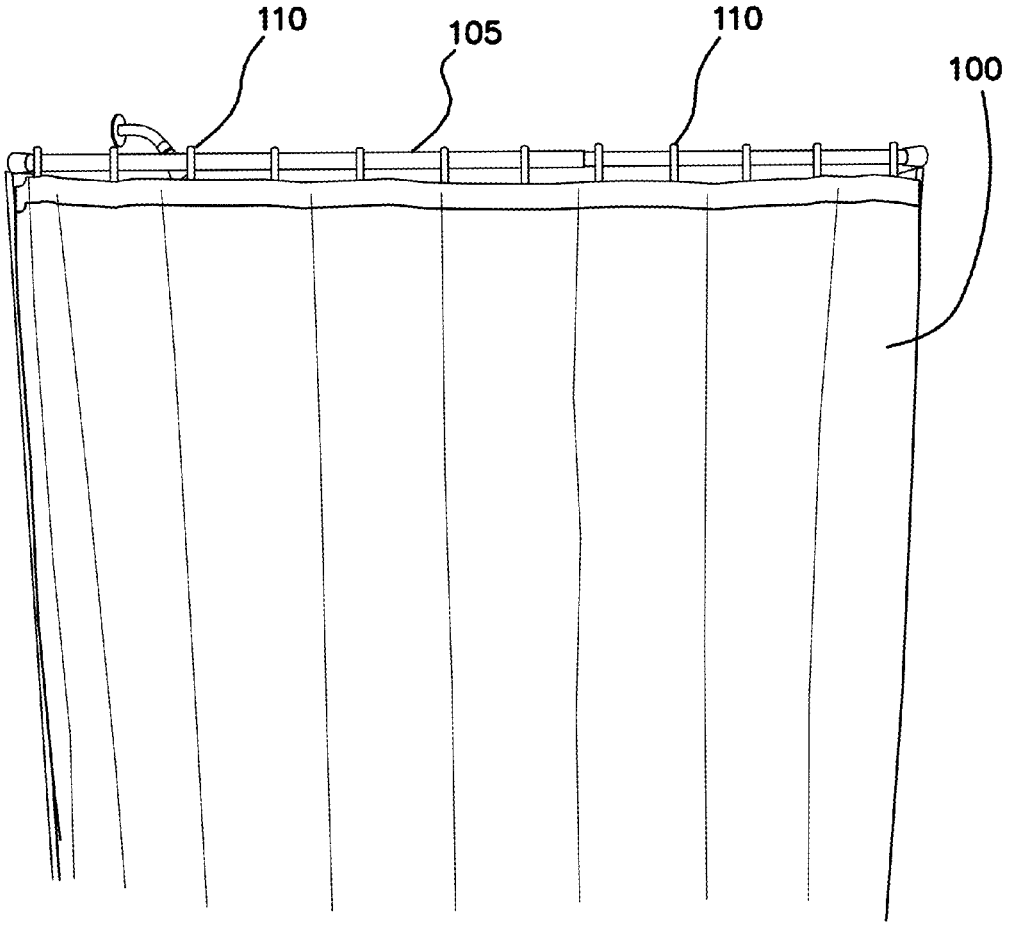
FIG. 5 illustrates a front view of a shower curtain attached to a shower curtain rod using a plurality of the first clips according to the embodiments of the present invention.
Figure 8:
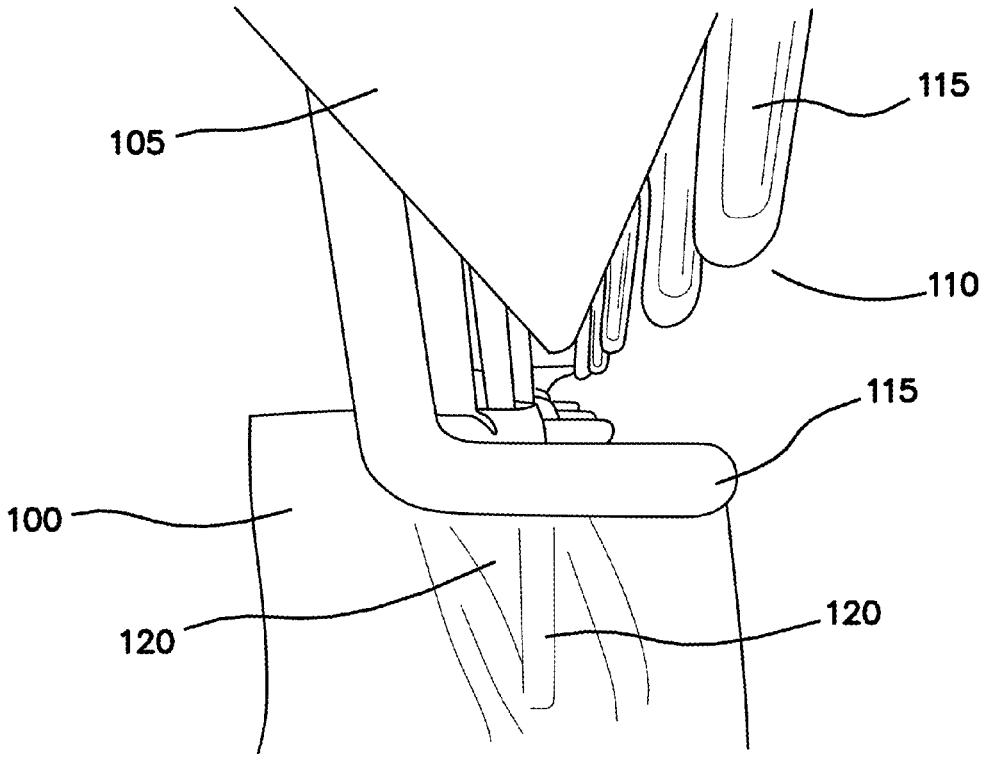
FIG. 8 illustrates a view along a shower curtain rod with the shower curtain hanging from the first clips according to the embodiments of the present invention.
Figure 9:
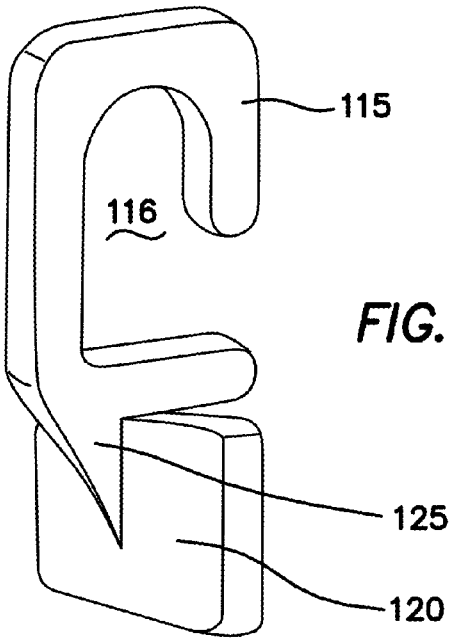
FIG. 9 illustrates a perspective view of the first clip according to the embodiments of the present invention.
Figure 11A:
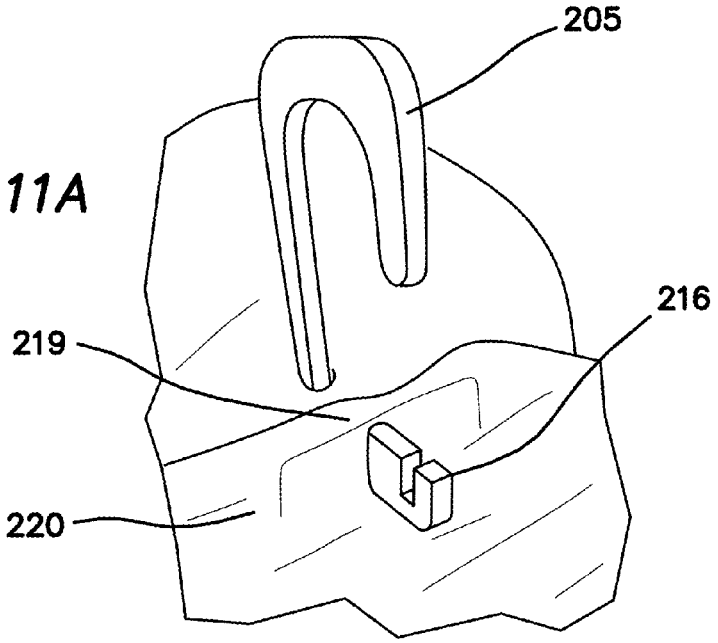
FIGS. 11A and 11B illustrate a perspective front and perspective rear view, respectively, of the second clip integrated with a shower curtain according to the embodiments of the present invention.
Figure 11B:
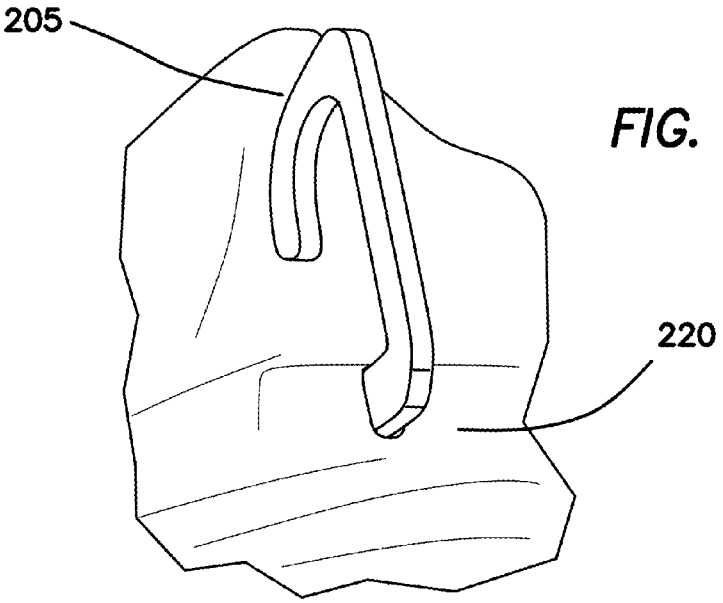

FIG. 5 illustrates a front view of a shower curtain attached to a shower curtain rod 105 using the first clips 110 according to the embodiments of the present invention. As shown, the shower curtain portion 120 is concealed by the shower curtain 100 providing a clean, smooth look. FIGS. 6 and 7 illustrate close-up front and perspective views of the square-shaped member 121 (represented by dotted lines) integrated within the shower curtain 100. FIG. 8 illustrates a view along a shower curtain rod 105 with the shower curtain 100 hanging thereon and FIG. 9 illustrates a rear perspective view of the first clip 110 according to the embodiments of the present invention.

For aesthetics purposes, the hanger portion 115 of the clip 110, may be covered in shower curtain material matching the shower curtain 100.

Figure 12A:
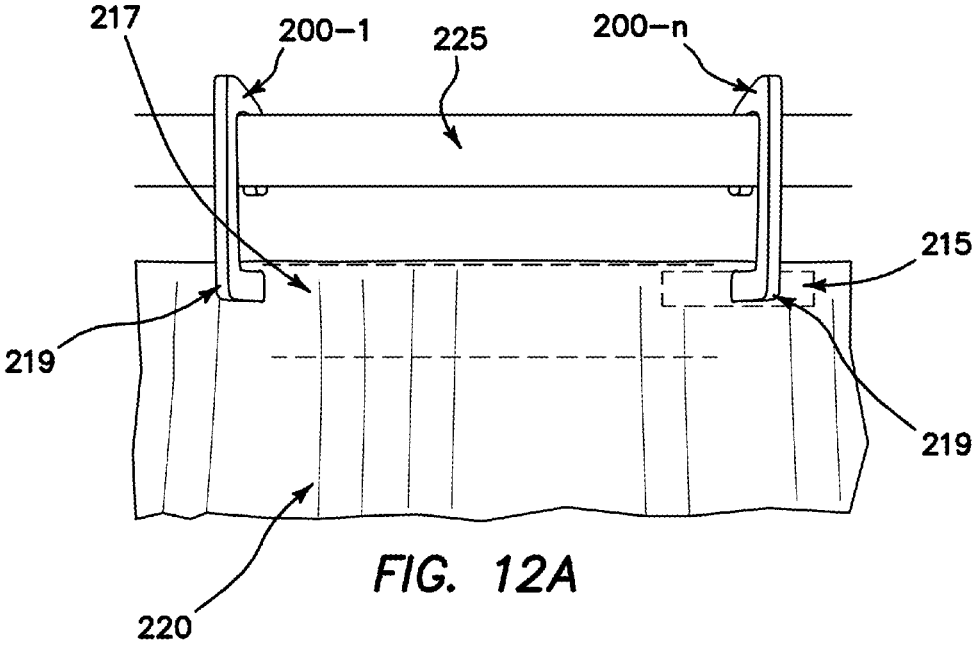
FIGS. 12A and 12B illustrate front and rear views of the second clip integrated with a shower curtain hanging on a shower curtain rod according to the embodiments of the present invention.
Figure 12B:
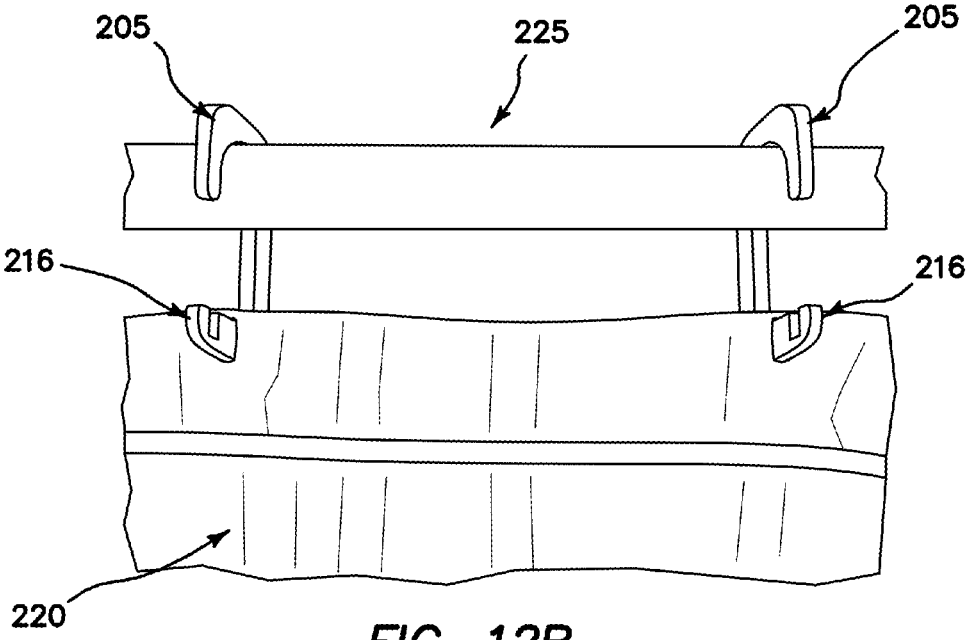

FIGS. 10A and 10B illustrate perspective front and side views, respectively, of a second shower curtain clip 200 according to the embodiments of the present invention. The second clip 200 includes a hook portion 205 configured to hook over and slide along a shower curtain rod. A lower shower curtain portion 210 (curtain portion for conventional drapes) of the clip 200 includes a rectangular retention member 215 and intersecting lower horizontal member 216 configured to retain a shower curtain. A cut-out 222 on said lower horizontal member 216 accepts a shower curtain liner which hangs adjacent to the shower curtain thereby allowing the shower curtain liner to be easily removed and replaced or washed separately. Such a configuration is ideal for seniors and handicap persons given the ease with which the curtain may be removed and washed as well as the ease with which the liner may be removed and reattached. With a conventional curtain, the cut-out 222 may allow a shade or similar article to be hung behind the curtain. As shown in FIGS. 11A-11B and 12A-12B, the rectangular retention member 215 (identified in FIG. 12A by dotted lines) inserts into an elongated internal space 217 (identified in FIG. 12A by dotted lines) defined by an elongated upper portion of a shower curtain 220 and wherein the lower horizontal member 216 extends through one of a series of openings 219 along the upper portion of the shower curtain 220 thereby concealing the rectangular retention member 215 (similar to square-shaped retention member 121 of the first clip 100). FIGS. 12A and 12B show front (i.e., from outside the bathtub/shower) and rear (from within the bathtub/shower) views of a plurality of the second clips 200-1 through 200-N supporting a shower curtain 215 attached to a shower curtain rod 225.

Figure 13A:
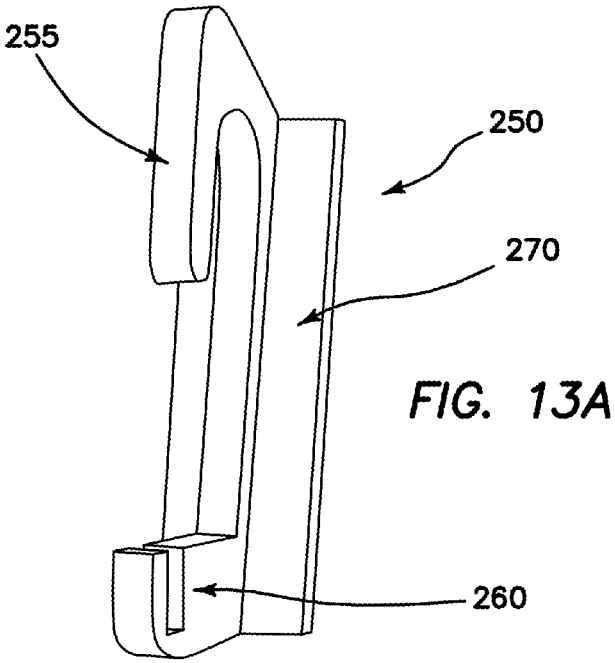
FIGS. 13A and 13B illustrate a perspective front and side view, respectively, of a third clip according to the embodiments of the present invention.
Figure 13B:
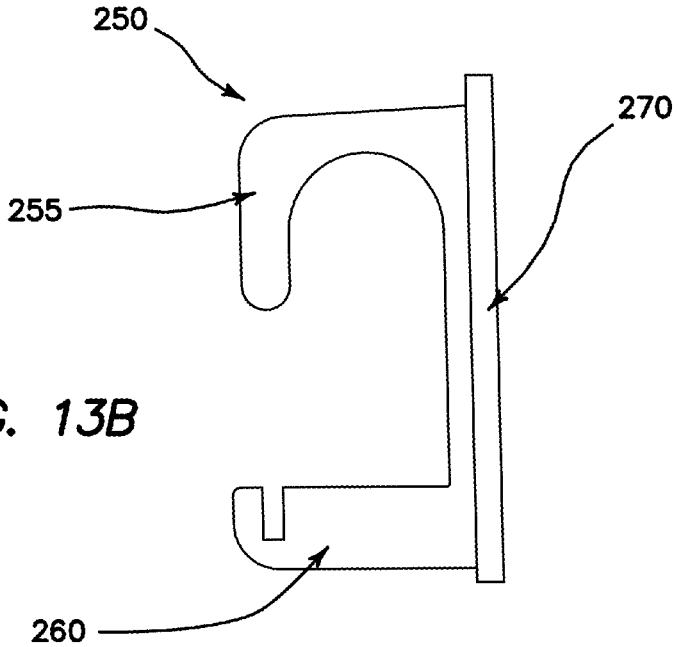

FIGS. 13A and 13B illustrate front and side views, respectively, of a third shower curtain clip 250 according to the embodiments of the present invention. The third clip 250 includes a hook portion 255 configured to hook over and slide along a shower curtain rod and a horizontal lower member 260. A cut-out 262 on said horizontal lower member 260 accepts a shower curtain liner which hangs adjacent to the shower curtain thereby allowing the shower curtain liner to be easily removed and replaced or washed separately. A rib 270 supports the hook portion 255 and horizontal lower member 260.

Figure 14:
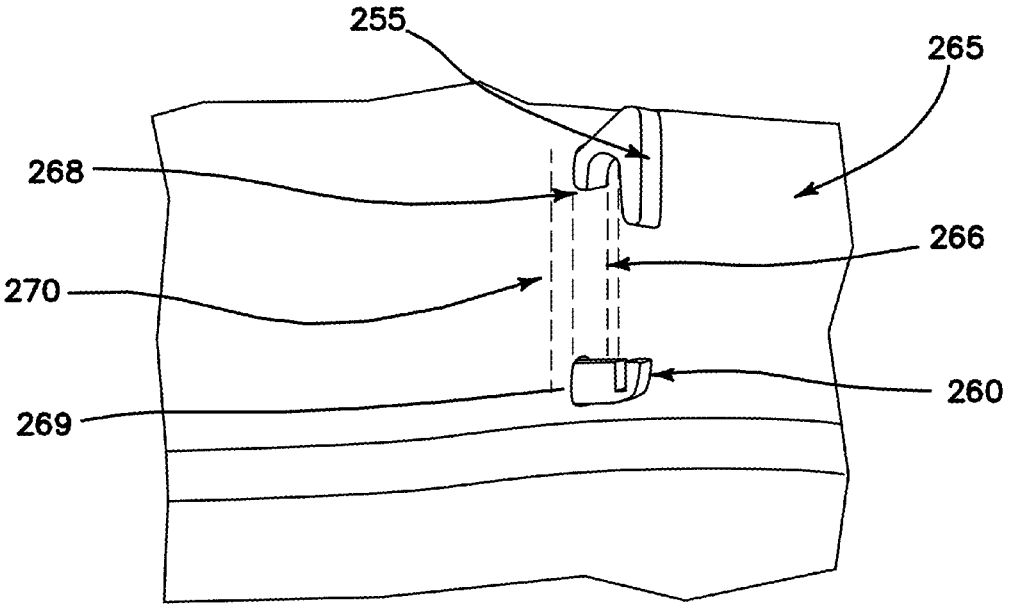
FIG. 14 illustrates the third clip integrated with a shower curtain according to the embodiments of the present invention.

FIG. 14 illustrates the third clip 250 integrated with a shower curtain 265 according to the embodiments of the present invention. As shown, the rib 270 is received by a space 266 (identified in FIG. 14 by dotted lines) in an upper portion of the shower curtain 265 thereby concealing the rib 270 (identified in FIG. 14 by dotted lines). The hook portion 255 and horizontal lower member 260 extend outward from upper openings 268 and lower openings 269, respectively, in the upper portion of the shower curtain 265.

Figure 15A:
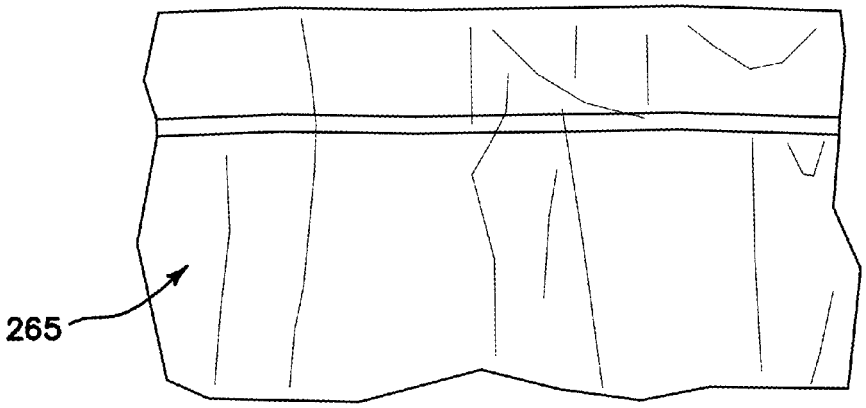
FIGS. 15A and 15B illustrate front and rear views of the shower curtain hanging on a shower curtain rod with the third clips in place according to the embodiments of the present invention.
Figure 15B:
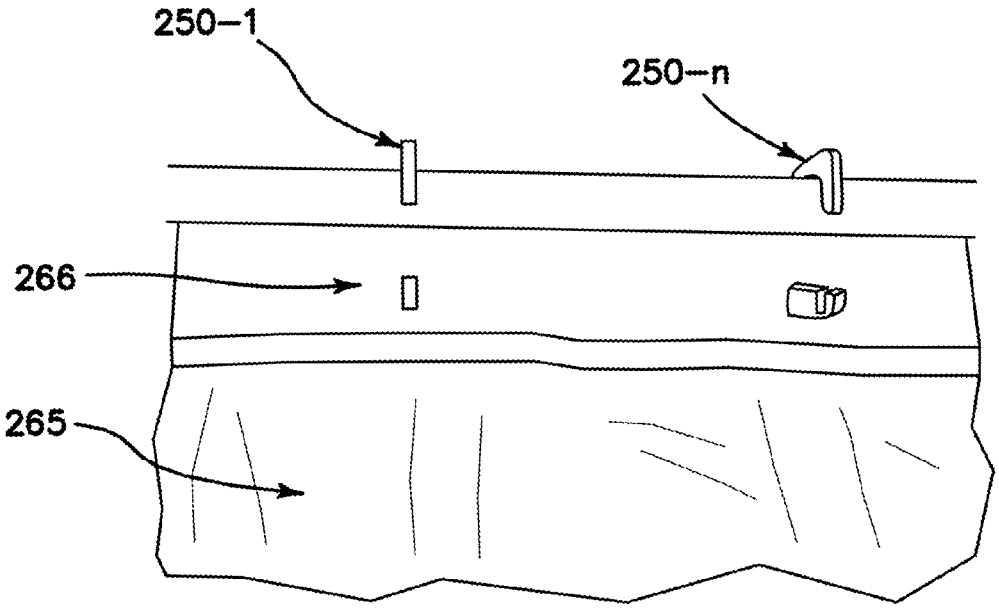

FIGS. 15A and 15B illustrate front (i.e., from outside the bathtub/shower) and rear (from within the bathtub/shower) views of the shower curtain 265 hanging on a shower curtain rod 225 with a plurality of third clips 250-1 through 250-N in place according to the embodiments of the present invention. As shown, the third clips 250-1 through 250-N are not visible at all from outside the bathtub/shower thereby creating an aesthetically pleasing smooth and clean appearance.

With the embodiments of the present invention, the clips 110, 200 and 250 have portions which insert into an internal space within an upper portion of the shower curtain. The internal space may run the length of the upper portion or may comprise individual, separate spaces positioned along the upper portion.

Figure 16:
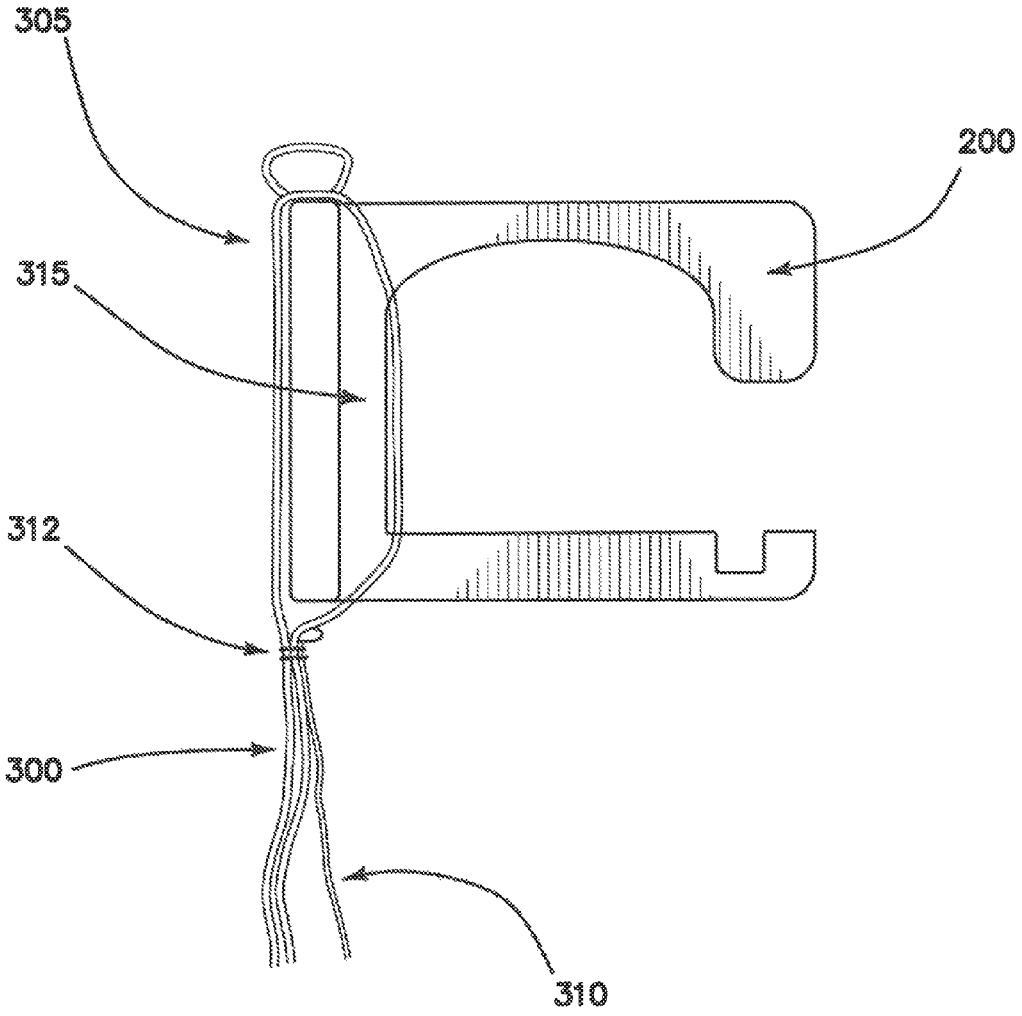
FIG. 16 illustrates an alternative shower curtain and shower curtain liner connected to one another and incorporating clips according to the embodiments of the present invention.
Figure 17:
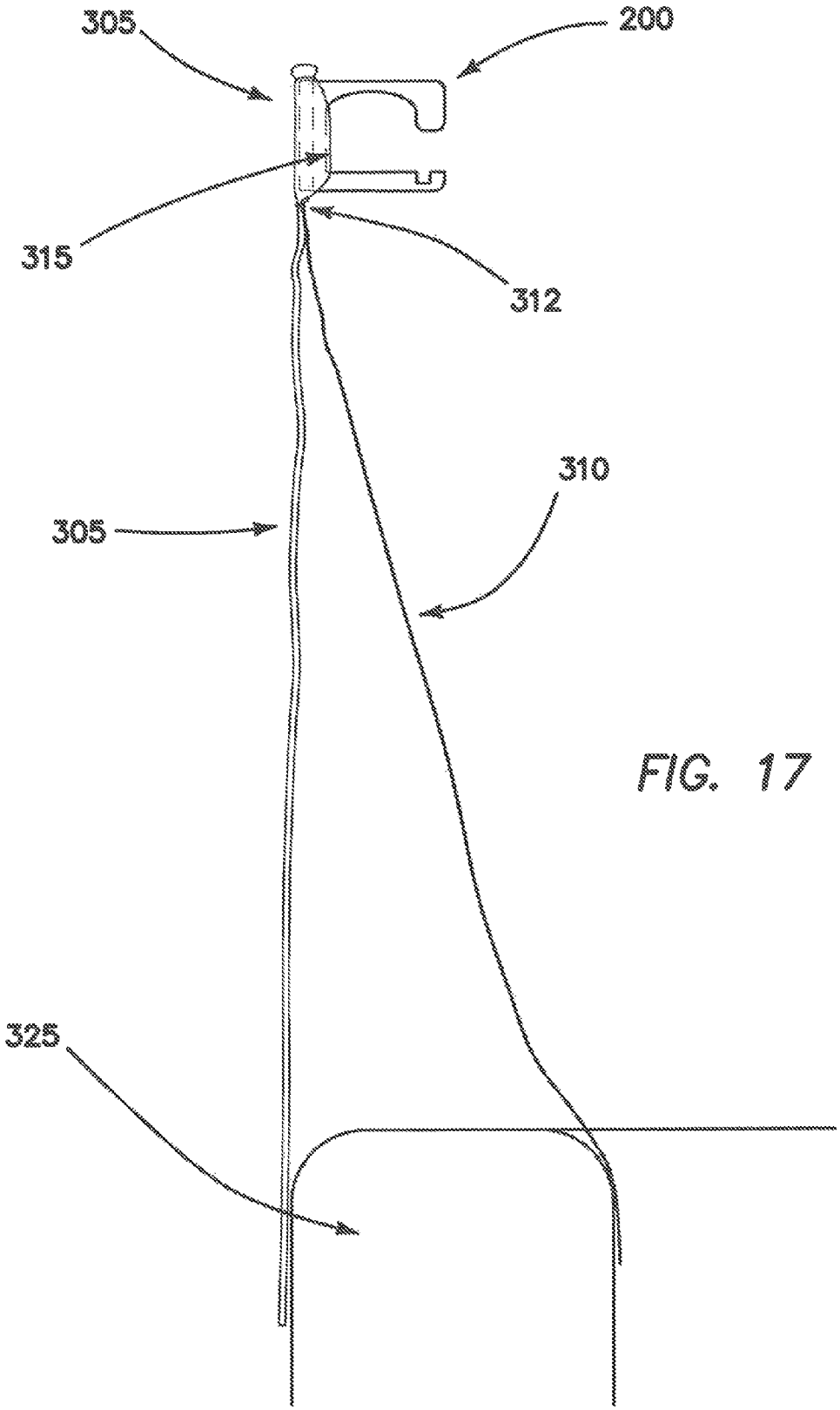
FIG. 17 illustrates an alternative shower curtain and shower curtain liner connected to one another and incorporating clips with reference to a bathtub wall according to the embodiments of the present invention.

FIG. 16 illustrates an alternative shower curtain and shower curtain liner connected to one another with clips/hooks within said shower curtain according to the embodiments of the present invention. In this embodiment, a shower curtain 300 and shower curtain liner 310 are attached to one another proximate to an upper portion 305 of said shower curtain 300 below the position of the clips/hooks 200. The shower curtain liner 310 may be attached 312 to the upper portion or below the same. In one embodiment, the shower curtain 300 and shower curtain liner 310 are sewn together but other means of attachment (e.g., clips, hook and loop fasteners, zipper, etc.) may be used. The shower curtain liner 310 is dimensioned substantially as the shower curtain 300. As with the embodiments above, the shower curtain 300, namely internal space 315, encapsulates a portion of the hooks/clips 200 (as described hereinafter, other hooks/clips may be used). FIG. 17 shows the shower curtain 300 and shower curtain liner 310 hanging from a shower curtain rod such that the shower curtain 300 hangs to an outside of the bath tub wall 325 while the shower curtain liner 310 hangs to the inside of the bath tub wall 325.

Figure 18A:
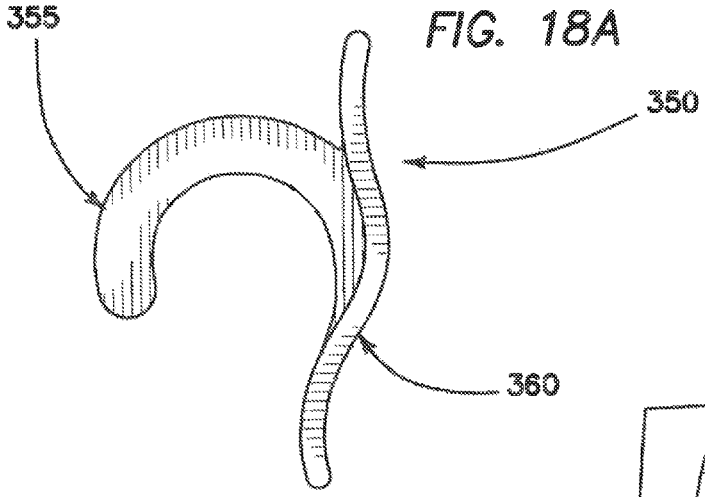
FIGS. 18A-18C illustrate an alternative design for a shower curtain clip according to the embodiments of the present invention.
Figure 18B:
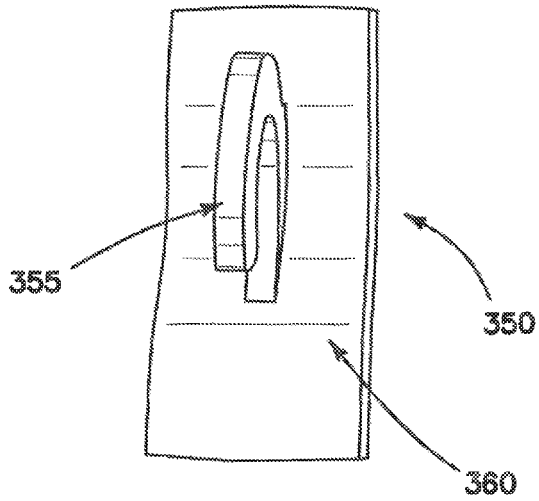
Figure 18C:
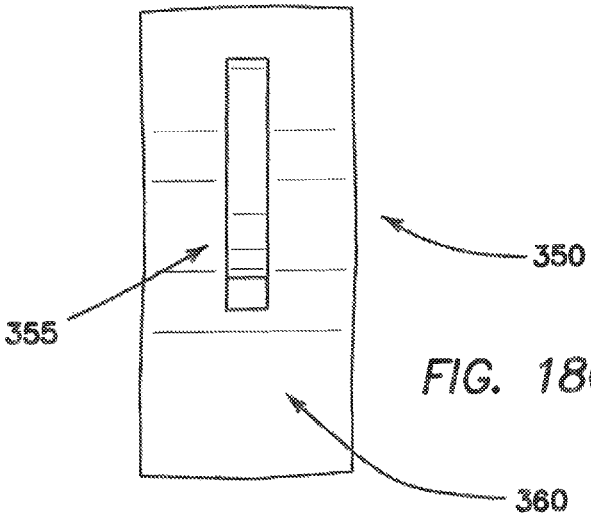

While the clips/hooks 100, 200 and 250 are suitable for the alternative shower curtain with attached shower curtain liner shown in FIGS. 16 and 17, in one embodiment, an alternative clip/hook 350 as shown in FIGS. 18A through 18C is used. The clip/hook 350 comprises a hanger portion 355 for hanging over a shower curtain rod such that a series of hanger portions 355 extending through openings in an inner space 315 defined by said upper portion 305 attach the shower curtain 300 and connected shower curtain liner 310 to the shower curtain rod. A curtain portion 360 of each of the clips/hooks 350 insert into the shower curtain 300 as described above such that the curtain portion 360 is substantially encapsulated by said inner space 315 of said upper portion 305 of the shower curtain 300. The hanger portion 355 is integral with, and extends from, the curtain portion 360. In one embodiment, the curtain portion 360 comprises one or more curves. Thus, the clips/hooks 350 are substantially incorporated with the shower curtain 300.

The embodiments of the present invention reduce or eliminate problems with conventional clips/hooks including the need to disengage hooks from the curtain rod.

Although the invention has been described in detail with reference to several embodiments, additional variations and modifications exist within the scope and spirit of the invention as described herein.

I claim:

1. A curtain comprising:

an upper portion defining an internal space, said internal space defined by two oppositely positioned sheets of material;

one or more multiple spaced openings positioned along said upper portion;

a waterproof liner attached to said curtain proximate to said upper portion, said waterproof liner dimensioned substantially as said curtain;

a series of clips, said clips each comprising a hanger portion and planar curtain portion, said hanger portion extending from a planar surface of said planar curtain portion, said hanger portions of each of said series of clips extending through said one of said multiple spaced openings in a direction substantially perpendicular to a surface of said upper portion, said hanger portions of each of said series of clips for slidably engaging a curtain rod, and wherein said curtain portion is received by, secured by and concealed by said upper portion substantially encapsulated by said internal space said planar curtain portion forming the greatest width of each of said clips, said width of said planar curtain portion providing support for said curtain.

2. The curtain of claim 1 wherein said planar curtain portion is rectangular-shaped.

3. The curtain of claim 1 wherein said planar curtain portion comprises a series of curves.

4. The curtain of claim 1 wherein said curtain portion and hanger portion are a single, integral member.

5. A shower curtain comprising:

an upper portion defining an internal space, said internal space defined by front and rear two oppositely positioned sections sheets of material;

one or more multiple spaced openings positioned horizontally along said upper portion;

a waterproof shower curtain liner attached to said curtain proximate to said upper portion, said waterproof shower curtain liner dimensioned substantially as said shower curtain; and a series of clips, said clips each comprising a hanger portion and planar curtain portion, said hanger portion extending from a planar surface of said planar curtain portion, said hanger portions of each of said series of clips extending through said one of said multiple spaced openings in a direction substantially perpendicular to a surface of said upper portion, said hanger portions of each of said series of clips for slidably engaging a curtain rod, and wherein said curtain portion is received by, secured by and concealed by said upper portion substantially encapsulated by said internal space, said planar curtain portion forming the greatest width of each of said clips, said width of said planar curtain portion providing support for said curtain.

6. The shower curtain of claim 5 wherein said planar curtain portion is rectangular-shaped.

7. The shower curtain of claim 5 wherein said planar curtain portion comprises a series of curves.

8. The curtain of claim 5 wherein said curtain portion and hanger portion are a single, integral member.

* * * * *